US009188135B2

(12) United States Patent
Nakayama et al.

(10) Patent No.: US 9,188,135 B2
(45) Date of Patent: Nov. 17, 2015

(54) AXIAL FLOW COMPRESSOR

(75) Inventors: Yoshihiro Nakayama, Takasago (JP); Yoshitaka Baba, Takasago (JP); Satoshi Ide, Takasago (JP); Koichiro Iizuka, Takasago (JP); Ryo Fujisawa, Kobe (JP); Masatake Toshima, Kobe (JP); Kunihiko Suto, Tokyo (JP); Kazutaka Kurashige, Tokyo (JP); Ichirou Sakuraba, Nagoya (JP); Daisuke Hayashi, Nagoya (JP); Keiji Sugano, Amagasaki (JP); Svend Rasmussen, Bjerringbro (DK); Ziad Al-Janabi, Hadsten (DK); Finn Jensen, Taastrup (DK); Lars Bay Moller, Aarhus (DK); Hans Madsboll, Taastrup (DK); Christian Svarregaard-Jensen, Skanderborg (DK); Klaus Damgaard Kristensen, Hojbjerg (DK)

(73) Assignees: Tokyo Electric Power Company, Incorporated, Tokyo (JP); Chubu Electric Power Company, Incorporated, Nagoya-shi (JP); THE KANSAI ELECTRIC POWER CO., INC., Osaka-shi (JP); KABUSHIKI KAISHA KOBE SEIKO SHO, Kobe-shi (JP); DANISH TECHNOLOGICAL INSTITUTE, Taastrup (DK); JOHNSON CONTROLS DENMARK APS, Hojbjerg (DK)

( * ) Notice: Subject to any disclaimer, the term of this patent is extended or adjusted under 35 U.S.C. 154(b) by 671 days.

(21) Appl. No.: 13/635,551

(22) PCT Filed: Mar. 15, 2011

(86) PCT No.: PCT/JP2011/001512
§ 371 (c)(1),
(2), (4) Date: Sep. 17, 2012

(87) PCT Pub. No.: WO2011/114715
PCT Pub. Date: Sep. 22, 2011

(65) Prior Publication Data

US 2013/0022474 A1 Jan. 24, 2013

(30) Foreign Application Priority Data

Mar. 17, 2010 (JP) ..... 2010-060579

(51) Int. Cl.
*F04D 29/32* (2006.01)
*F04D 29/053* (2006.01)
(Continued)

(52) U.S. Cl.
CPC ..... *F04D 29/266* (2013.01); *F04D 19/02* (2013.01); *F04D 29/023* (2013.01); *F04D 29/053* (2013.01); *F04D 29/321* (2013.01)

(58) Field of Classification Search
CPC ..... F04D 19/02; F04D 29/023; F04D 29/321; F04D 29/053; F04D 29/266
See application file for complete search history.

(56) References Cited

U.S. PATENT DOCUMENTS 6,599,084 B1 * 7/2003 Schutz et al. ..... 415/90
6,905,306 B2 * 6/2005 Englander et al. ..... 415/200
(Continued)

FOREIGN PATENT DOCUMENTS

JP 54 128809 10/1979
JP 58 146001 10/1983
(Continued)

OTHER PUBLICATIONS

International Search Report Issued on Jun. 14, 2011 in PCT/JP11/01512 Filed Mar. 15, 2011.
International Preliminary Report on Patentability Issued Oct. 23, 2012 in PCT/JP11/001512 Filed Mar. 15, 2011.

*Primary Examiner* — Igor Kershteyn
(74) *Attorney, Agent, or Firm* — Oblon, McClelland, Maier & Neustadt, L.L.P.

(57) ABSTRACT

An axial flow compressor includes: a rotor having a rotor vane; a first pressing member joined to one end surface of the rotor; a second pressing member joined to the other end surface of the rotor; a rotor shaft portion penetrating the first pressing member, the rotor and the second pressing member; and a nut which fixes the first pressing member and the second pressing member on the rotor shaft portion with the first pressing member and the second pressing member holding the rotor between. The rotor shaft portion is made of a material having a lower linear expansion coefficient than that of a material making at least a part of the rotor. The material making at least a part of the rotor may be aluminum or aluminum alloy.

9 Claims, 4 Drawing Sheets

(51) Int. Cl.

| | |
|---|---|
| ***F04D 29/26*** | (2006.01) |
| ***F04D 19/02*** | (2006.01) |
| ***F04D 29/02*** | (2006.01) |

(56) References Cited

U.S. PATENT DOCUMENTS

| | | | | |
|---|---|---|---|---|
| 6,948,913 | B2 * | 9/2005 | Heyes et al. | 416/204 R |
| 7,367,774 | B2 | 5/2008 | Bourget et al. | |
| 7,909,578 | B2 | 3/2011 | Nishiyama et al. | |

FOREIGN PATENT DOCUMENTS

| | | |
|---|---|---|
| JP | 58 217702 | 12/1983 |
| JP | 63 85202 | 4/1988 |
| JP | 5 21200 | 3/1993 |
| JP | 2002 541378 | 12/2002 |
| JP | 2005 23903 | 1/2005 |
| JP | 2005 299662 | 10/2005 |
| WO | 2006 043556 | 4/2006 |

* cited by examiner

AXIAL FLOW COMPRESSOR

TECHNICAL FIELD

The present invention relates to an axial flow compressor compressing, for example, water vapor.

BACKGROUND ART

A rotor used for a compressor such as an axial flow compressor is securely fitted to a rotor shaft portion and thereby prevented from being displaced in the circumferential directions with respect to the rotor shaft portion when the axial flow compressor is in operation. For example, the following Patent Document 1 discloses that the fitting of a rotor and a rotor shaft portion is conducted by key coupling, tooth coupling or polygon fitting.

As given even in the following Patent Document 1, however, key coupling has a disadvantage in that a fitting hole may enlarge to thereby vibrate the rotor shaft portion. Tooth coupling or polygon fitting takes a great deal of time and labor for coupling working, thereby raising manufacturing costs.

LIST OF PRIOR ART DOCUMENTS

Patent Documents

Patent Document 1: Japanese Utility Model Laid-Open Publication No. 5-21200

SUMMARY OF THE INVENTION

It is an object of the present invention to solve the mentioned problem.

It is an object of the present invention to provide an axial flow compressor capable of suppressing costs necessary for working the fitting parts of a rotor and a rotor shaft portion and fitting the rotor securely with respect to the rotor shaft portion.

An axial flow compressor according to an aspect of the present invention which compresses a working fluid includes: a rotor including a rotor vane; a first pressing member coming into contact with one end surface of the rotor; a second pressing member coming into contact with the other end surface of the rotor; a rotor shaft portion penetrating the first pressing member, the rotor and the second pressing member; and a fixing portion which fixes the first pressing member and the second pressing member on the rotor shaft portion with the first pressing member and the second pressing member holding the rotor between, in which the rotor shaft portion is made of a material having a lower linear expansion coefficient than that of a material making at least a part of the rotor.

DESCRIPTION OF EMBODIMENTS

An embodiment of the present invention will be below described in detail with reference to the drawings.

Figure 1:
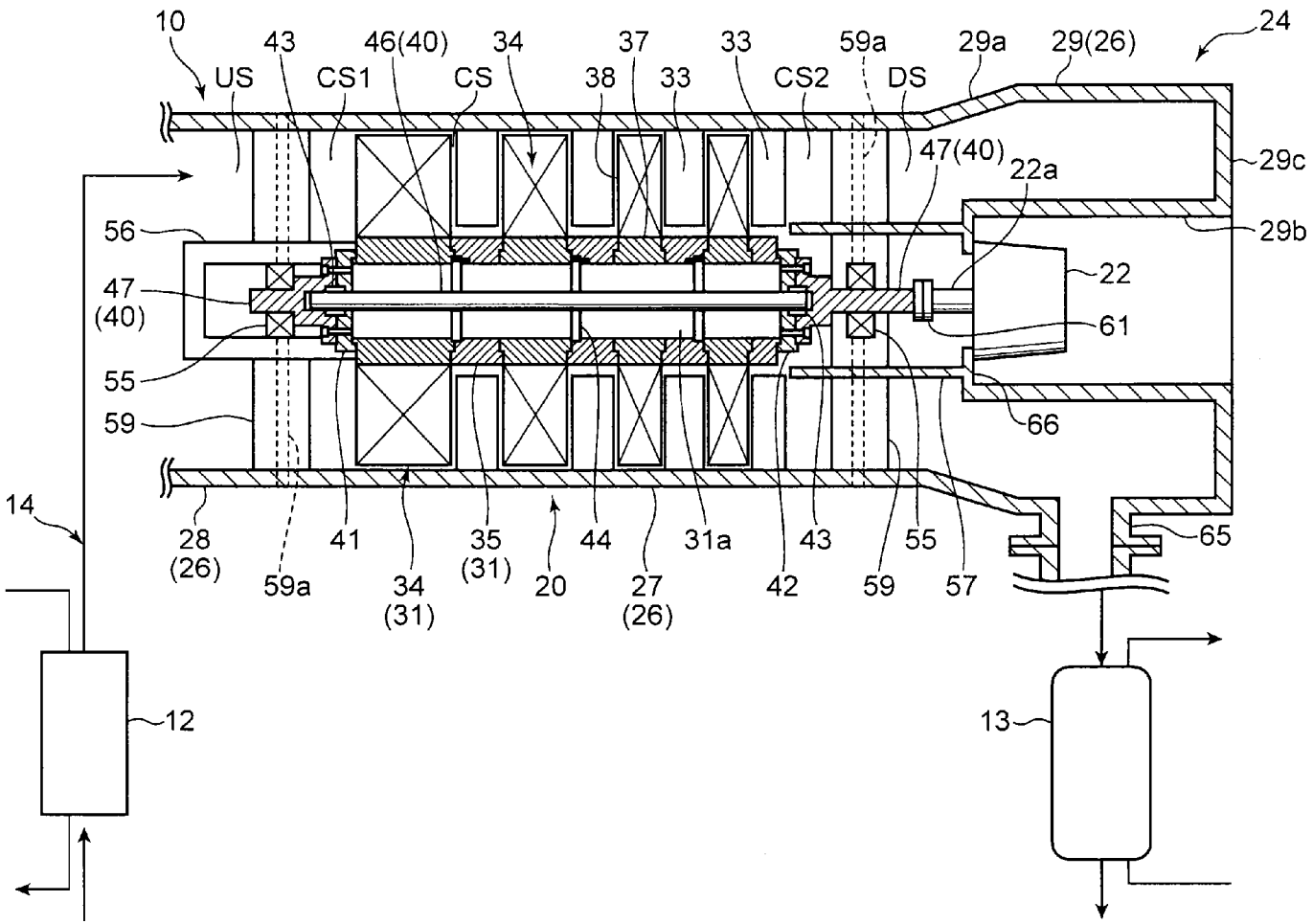
FIG. 1 is a schematic view showing a configuration of an axial flow compressor according to an embodiment of the present invention.

As shown in FIG. 1, an axial flow compressor 10 according to the embodiment is a compressor for a refrigerator and provided on a refrigerant circuit 14 including an evaporator 12 and a condenser 13. The axial flow compressor 10 compresses water vapor as a working fluid (refrigerant) evaporated in the evaporator 12. The water vapor is a relatively low-temperature and low-pressure vapor, and after compressed in the axial flow compressor 10 according to the embodiment, the water vapor as the working fluid has a temperature in the range of e.g. from 5° C. to 150° C. under an atmospheric pressure or below in a region from a suction opening to a discharge opening of the axial flow compressor 10. In the case where the axial flow compressor 10 is provided with plural stages of rotor vanes e.g. seven stages of rotor vanes, the water vapor has a temperature in the range of e.g. from 5° C. to 250° C. Through the refrigerant circuit 14, the working fluid compressed in the axial flow compressor 10 is sent to the condenser 13 and condensed there. In this way, the working fluid undergoes phase changes and circulates through the refrigerant circuit 14. The evaporator 12 evaporates the refrigerant and thereby supplies a secondary heating medium with cold heat, and the secondary heating medium is supplied to a user unit (not shown) cooling an object to be cooled such as room air.

The axial flow compressor 10 includes a compression portion 20 having a compression space CS for compressing a working fluid, an electric motor 22 driving the compression portion 20, and a velocity reducing portion 24 reducing the flow velocity of the working fluid discharged from the compression space CS. The axial flow compressor 10 includes a casing 26 formed by: a first case portion 27 arranged in the compression portion 20 and having a cylindrical shape; a second case portion 28 arranged on one end side (upstream side) of the compression portion 20; and a third case portion 29 arranged in the velocity reducing portion 24 on the other end side (downstream side) of the compression portion 20.

The compression portion 20 includes the first case portion 27 and a rotor 31 inside of the first case portion 27. The space between the first case portion 27 and the rotor 31 functions as the compression space CS for compressing a working fluid. The compression space CS includes a suction opening CS1 on the left and a discharge opening CS2 on the right of FIG. 1. Through the suction opening CS1 on the left, the working fluid evaporated in the evaporator 12 is sucked into the compression space CS, compressed as it goes to the right and discharged from the discharge opening CS2.

On the inner circumferential surface of the first case portion 27, a plurality of stationary vanes 33 are fixed apart from each other in the axial directions. The first case portion 27 is set in such a way that the axial directions are horizontal.

The rotor 31 includes a plurality of rotor vanes 34 apart from each other in the axial directions and alternate with the stationary vanes 33, and a plurality of spacers 35. Each spacer 35 is a cylindrical member and arranged inside in the radial directions of the corresponding stationary vane 33 and between the corresponding adjacent rotor vanes 34. FIG. 1 shows the four rotor vanes 34 and the four spacers 35, but the present invention is not limited to this configuration.

The rotor vane 34 includes a cylindrical boss portion 37 and a vane portion 38 around and united with the boss portion 37. As described later, the rotor vane 34 is made of aluminium or aluminium alloy and a unit formed by cutting a single blank. The boss portion 37 is formed in the peripheral directions with a plurality of the vane portions 38 and has outer and inner circumferential surfaces flush with those of the spacers 35.

The compression portion 20 includes a driving shaft 40, a first pressing member 41, a second pressing member 42, a nut 43 as an example of the fixing portion, and a disk member 44. The driving shaft 40 includes a rotor shaft portion 46 and an end shaft portion 47, 47 arranged at each end of the rotor shaft portion 46.

Figure 2:
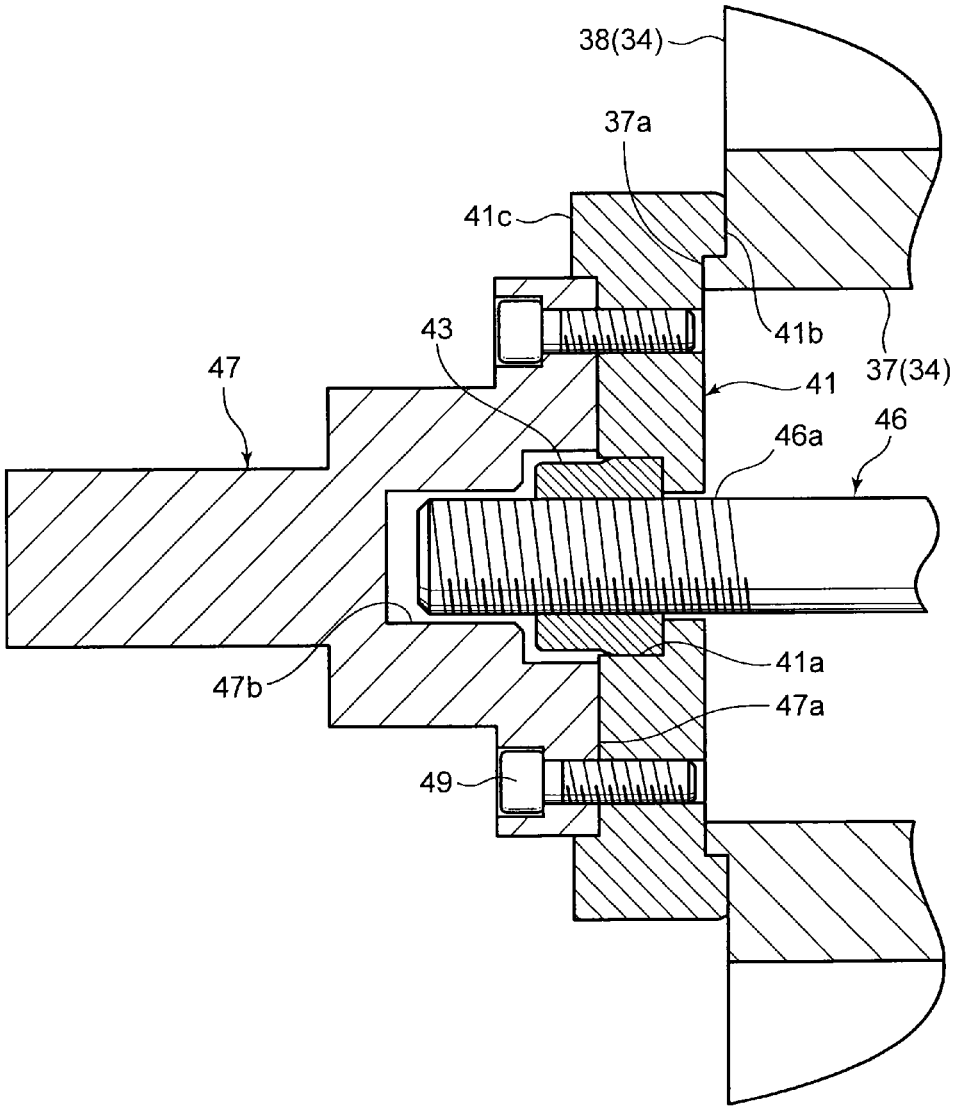
FIG. 2 is a sectional view mainly showing the fitting part of a rotor vane and a first pressing member.

The rotor shaft portion 46 is on the axial center of the first case portion 27 and extends in the axial directions thereof. Both ends of the rotor shaft portion 46 are outside of the rotor vanes 34 and the spacers 35 in the axial directions and are provided with an external thread portion 46*a* (FIG. 2).

The first pressing member 41 is arranged in contact with the most upstream rotor vane 34 while the second pressing member 42 is arranged in contact with the spacer 35 outside of the most downstream rotor vane 34. The first and second pressing members 41 and 42 are arranged opposite in the axial directions, even though having the same configuration.

The first pressing member 41 has a disk shape and the pressing member 41 is formed with a central through hole 41*a* for inserting the rotor shaft portion 46. As enlarged in FIG. 2, the central through hole 41*a* is a stepped hole having a step in the middle and is formed with a small diameter part having an inner diameter at which the rotor shaft portion 46 can be inserted while the nut 43 cannot and a large diameter part having an inner diameter at which the nut 43 can be inserted.

The first pressing member 41 is formed with: a rotor-side fitting portion 41*b* protruding from one end surface in the axial directions of a peripheral edge part thereof; and an end-side fitting portion 41*c* protruding from the other end surface in the axial directions of a peripheral edge part thereof, both portions 41*b* and 41*c* being united therewith.

The rotor-side fitting portion 41*b* has a ring shape concentric with the central through hole 41*a* if seen in the axial directions and has a flat end surface in the axial directions. The rotor-side fitting portion 41*b* is fitted to an end fitting portion 37*a* formed in the boss portion 37 of the rotor vane 34.

The most upstream rotor vane 34 has the end fitting portion 37*a* of the boss portion 37 formed in the end surface thereof (outer end surface in the axial directions of the rotor 31) on the suction opening CS1 side. The end fitting portion 37*a* has a ring shape concentric with the boss portion 37 and has a flat end surface in the axial directions. The end fitting portion 37*a* is fitted into the rotor-side fitting portion 41*b* of the first pressing member 41 by press fitting or the like. Hence, the rotor-side fitting portion 41*b* of the first pressing member 41 is fitted to the end fitting portion 37*a* of the rotor vane 34, and thereby, the axial center of the first pressing member 41 coincides with the axial center of the most upstream rotor vane 34. Both the end fitting portion 37*a* and the rotor-side fitting portion 41*b* have a flat end surface in the axial directions, thereby suppressing costs necessary for working the boss portion 37 and the first pressing member 41, as is applied to the second pressing member 42 as well.

The end-side fitting portion 41*c* has a ring shape if seen in the axial directions and is fitted to a flange portion 47*a* formed at the end of the end shaft portion 47. The flange portion 47*a* has a ring shape concentric with the end-side fitting portion 41*c*. The flange portion 47*a* is fitted into the end-side fitting portion 41*c*, thereby the end shaft portion 47 and the first pressing member 41 become coaxial with each other, and in this state, the end shaft portion (first end shaft portion) 47 and the first pressing member 41 are mutually fixed using bolts 49. The end shaft portion 47 has a concave portion 47*b* sinking inward from the end surface thereof on the flange portion 47*a* side, and the concave portion 47*b* can receive the nut 43 and an end part of the rotor shaft portion 46.

Similarly to the first pressing member 41, the second pressing member 42 is formed with a central through hole as a stepped hole, and a rotor-side fitting portion and an end-side fitting portion. The rotor-side fitting portion of the second pressing member 42 is fitted to an end fitting portion of the spacer 35 outside of the most downstream rotor vane 34. The end fitting portion is formed in the end surface of the spacer 35 (outer end surface in the axial directions of the rotor 31) on the discharge opening CS2 side and has the same shape as the end fitting portion 37*a* of the most upstream rotor vane 34. The end-side fitting portion of the second pressing member 42 is fitted to a flange portion of the end shaft portion (second end shaft portion) 47 on the discharge side, and the flange portion has the same shape as the flange portion 47*a* of the first end shaft portion 47.

The nut 43 is screwed onto the external thread portion 46*a* of the rotor shaft portion 46 inserted through the central through hole 41*a*. In this manner, the first pressing member 41 and the second pressing member 42 are fastened with the nuts 43 from both sides in the axial directions with holding the rotor 31 (the rotor vanes 34 and the spacers 35) between the pressing members 41 and 42. The nut 43 is tightened up by a predetermined torque value to thereby fasten the first pressing member 41 and the second pressing member 42. The "predetermined torque value" is set, as described later, taking into account the fact that the difference in linear expansion coefficient between the rotor 31 and the rotor shaft portion 46 or the difference in expansion volume between both in operation makes the coupling force of the nut 43 greater in operation than when the rotor 31 is assembled. Therefore, the rotor vanes 34 adjacent to each other and spacer 35 are fitted to each other.

Figure 3:
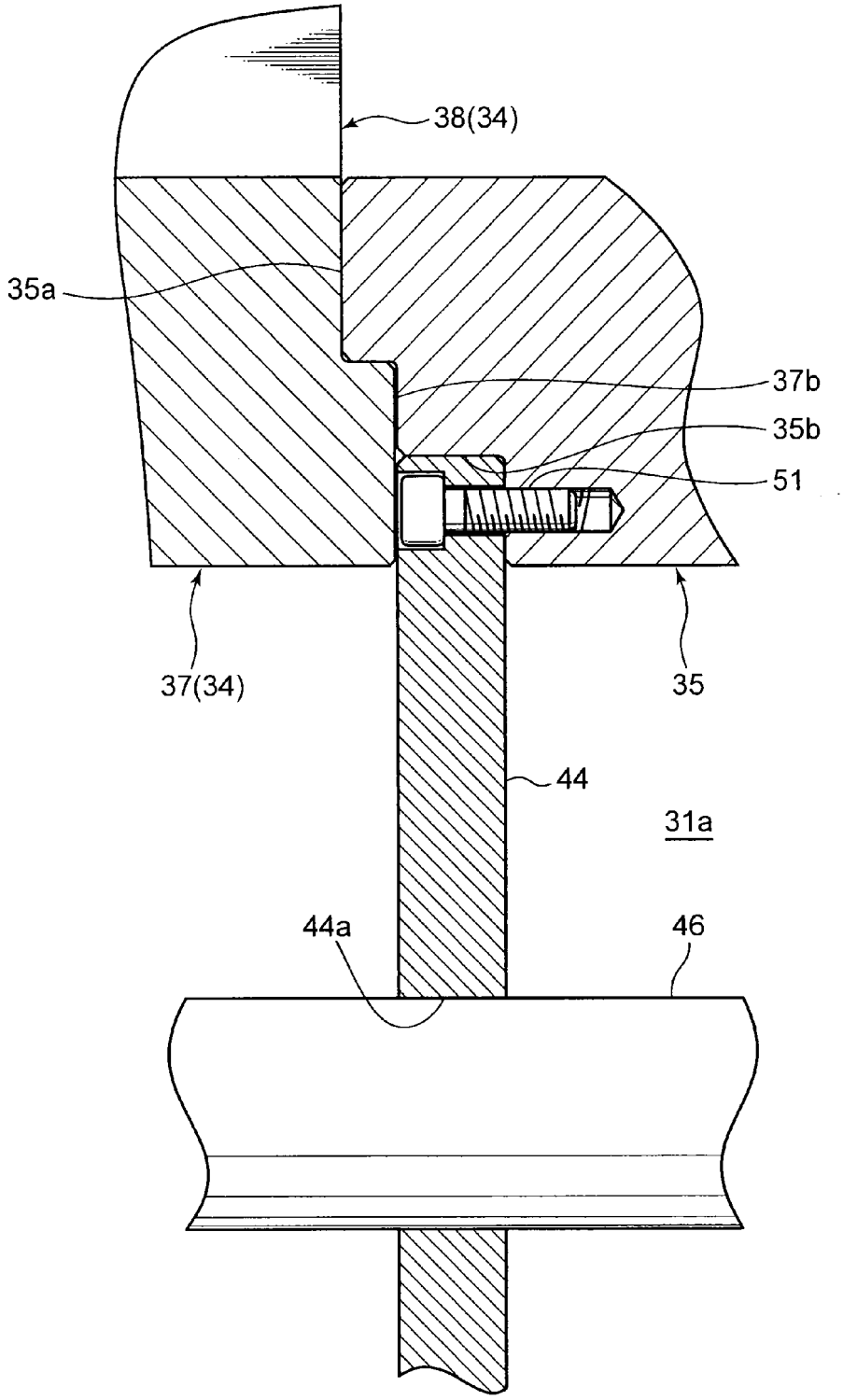
FIG. 3 is a sectional view mainly showing the fitting part of a rotor vane and a spacer.

As shown in FIG. 3, the mutually adjacent rotor vane 34 and spacer 35 are fitted to each other. Specifically, the boss portion 37 of the rotor vane 34 has a first fitting portion 37*b* formed on the end face side thereof facing the spacer 35 and protruding in the axial direction. The boss portion 37 is cylindrical, and the first fitting portion 37*b* has a ring shape concentric with the boss portion 37 along the inner circumferential part of the boss portion 37 and has a flat end surface in the axial directions. On the other hand, the spacer 35 has a second fitting portion 35*a* formed on the end face side thereof facing the boss portion 37 of the rotor vane 34 and protruding in the axial direction. The second fitting portion 35*a* has a ring shape concentric with the spacer 35 along the outer circumferential part of the spacer 35 and has a flat end surface in the axial directions. Since the inner diameter of the second fitting portion 35*a* corresponds to the outer diameter of the first fitting portion 37*b*, both portions 37*b* and 35*a* are fitted to each other to thereby couple the rotor vane 34 and the spacer 35 concentrically. In sum, the rotor vane 34 and the spacer 35 are separate and then fitted to each other. Both the first fitting portion 37*b* of the boss portion 37 and the second fitting portion 35*a* of the spacer 35 have a flat end surface in the axial directions, thereby suppressing costs necessary for working the boss portion 37 and the spacer 35.

The spacer 35 and the boss portion 37 have an inner diameter far larger than the outer diameter of the rotor shaft portion 46. Between the cylindrical part formed by the connected spacer 35 and boss portion 37 and the rotor shaft portion 46, therefore, a space extending in the axial directions is formed, and a disk member 44 is provided in this space or an inner space 31*a* of the rotor 31. The spacer 35 is formed inward from the second fitting portion 35*a* with a concave portion 35*b* having a width corresponding to the thickness of the disk member 44. The periphery of the disk member 44 is inserted into the concave portion 35*b*, and in this state, the disk member 44 is fastened onto the spacer 35 with a bolt 51. In other words, the disk member 44 is sandwiched with no gap between the boss portion 37 of the rotor vane 34 and the spacer 35.

The disk member 44 is perpendicularly postured to the rotor shaft portion 46 and formed at the center with a through hole 44*a* penetrating in the thickness directions. The rotor shaft portion 46 is inserted in the through hole 44*a* and thereby supported with each disk member 44 at a plurality of places in the middle thereof.

A temperature difference is generated between the upstream rotor vanes 34 and the downstream rotor vanes 34 in operation. Accordingly, a relative positional relation between each disk member 44 and the rotor shaft portion 46 is changed in the axial direction of the rotor shaft portion 46, resulting from thermal expansion of the rotor vanes 34 and the spacers 35 in contact therewith. In view of the above, it is preferable to make the rotor shaft portion 46 easily movable relative to each disk member 44 in the axial direction in order to operate the axial flow compressor 10 for a long time. Thus, an inner surface of the through hole 44*a* of each disk member 44, and an outer surface of the rotor shaft portion 46 may be formed into a smooth surface by a surface treatment such as polishing or other means.

The rotor vanes 34 are all made of aluminum or aluminum alloy and the spacers 35 are all made of aluminum or aluminum alloy; in other words, the rotor 31 is made of aluminum or aluminum alloy. On the other hand, the rotor shaft portion 46 is made of titanium or titanium alloy which is a material having a lower linear expansion coefficient than that of aluminum. Therefore, the axial flow compressor 10 generates heat in operation to thereby expand the rotor 31 by more volume than the rotor shaft portion 46 in the axial directions. The rotor vanes 34 may also be made of different material from the mentioned above.

The first pressing member 41 and the second pressing member 42 are made of stainless steel or stainless alloy, and the disk member 44 is made of aluminium or aluminium alloy. The first pressing member 41, the second pressing member 42, and the disk member 44 may also be made of different material from the mentioned above.

In the embodiment, the rotor vanes 34 including the most upstream rotor vane 34 are made of aluminum or aluminum alloy. At least the most upstream rotor vane 34 may be subjected to anodic coating, thereby effectively preventing the rotor vanes 34 from being eroded while lightening the rotor vanes 34. Further, the most upstream rotor vane 34 may be made of titanium, titanium alloy, stainless steel or stainless alloy, thereby preventing the most upstream rotor vane 34 from being eroded and simultaneously making it more durable.

As shown in FIG. 1, the end shaft portion 47, 47 at each end is supported with a bearing 55, 55 and is coaxial with the rotor shaft portion 46. The bearing 55 supports the end shaft portion 47 at a main portion 47*c* thereof with the end shaft portion 47 rotatable. The main portion 47*c* is opposite to the flange portion 47*a* and extends coaxially with the rotor shaft portion 46.

Both bearings 55 and 55 are placed in an upstream housing 56 at one end and a downstream housing 57 at the other end, respectively. The upstream housing 56 and the second case portion 28 form a cylindrical space therebetween and this space becomes an upstream space US for flowing the working fluid led into the compression space CS. On the other hand, the downstream housing 57 and the third case portion 29 form a cylindrical space therebetween and this space becomes a downstream space DS for flowing the working fluid led from the compression space CS.

Each housing 56, 57 is supported to the second case portion 28 or the third case portion 29 via a plurality of support members 59, 59 each having a rod shape and arranged radially in the circumferential directions. Each support member 59, 59 has a streamline shape in section and thereby does not block a flow of a working fluid even in the upstream space US and the downstream space DS. The figure shows an example where the support member 59 comes into the housing 57 in the downstream space DS, but this part coming into the housing 57 not necessarily has a rod shape.

The support member 59 is formed with supply-and-discharge passages 59*a* for supplying and discharging a lubricant. The lubricant is introduced from outside of the second case portion 28 and the third case portion 29, fed through one supply-and-discharge passage 59*a* to the bearing 55 and discharged through the other supply-and-discharge passage 59*a* from the bearing 55.

The end shaft portion 47 on the discharge opening CS2 side is inside of the downstream housing 57 and connected to a rotating shaft 22*a* of the electric motor 22 via a flexible coupling 61. The driving shaft 40 of the compression portion 20 is connected without any speed-up gear to the rotating shaft 22*a* of the electric motor 22 and thereby the rotor 31 has the same rotational speed as that of the electric motor 22.

The above described velocity reducing portion 24 has the downstream space DS formed with the third case portion 29. The third case portion 29 has an outer circumferential surface portion 29*a* connected to an end of the first case portion 27 in the axial directions, an inner circumferential surface portion 29*b* inward from the outer circumferential surface portion 29*a* and extending in the axial directions, an end surface portion 29*c* connecting ends of the outer circumferential surface portion 29*a* and the inner circumferential surface portion 29*b* in the axial directions.

The outer circumferential surface portion 29*a* is formed with an outlet port 65 connected to piping for leading, to the condenser 13, a working fluid whose flow velocity is reduced inside of the downstream space DS.

The inner circumferential surface portion 29*b* is formed with a motor support portion 66 extending inward in the radial directions from the connection part thereof to the housing 57. The electric motor 22 is placed inward from the inner circumferential surface portion 29*b* of the velocity reducing portion 24 and attached to the motor support portion 66.

In the axial flow compressor 10 according to the embodiment, as the rotating shaft 22*a* of the electric motor 22 rotates, the driving shaft 40 of the compression portion 20 rotates at the same rotational speed to rotate the rotor 31 around the axis thereof. This rotation causes a working fluid inside of the upstream space US to be sucked through the suction opening CS1 into the compression space CS, compressed and sent to the right of FIG. 1 in the compression space CS and discharged through the discharge opening CS2 to the downstream space DS. In the velocity reducing portion 24, the flow velocity of the working fluid is reduced and the pressure thereof recovered, and then, it is discharged through the outlet port 65.

As described so far, in the embodiment, the first pressing member 41 and the second pressing member 42 hold the rotor 31 from both sides in the axial directions. The axial flow compressor 10 generates heat when compressing water vapor in operation to thereby expand, in the axial directions, the rotor 31 by more volume than the rotor shaft portion 46 because the rotor shaft portion 46 is made of a material having a lower linear expansion coefficient than that of aluminum making the rotor 31. Hence, the rotor 31 expands to increase the pressing force between the rotor 31 and the first pressing member 41 and the pressing force between the rotor 31 and the second pressing member 42, thereby making the coupling force of the nut 43 greater in operation than when the rotor 31 is assembled. Therefore, without tooth coupling, key coupling or the like, the rotor 31 can be fitted to the pressing members 41 and 42 lest the rotor 31 should be relatively displaced in the circumferential directions, thereby suppressing costs necessary for working the fitting parts. Particularly, the end surfaces of the fitting parts in the axial directions (e.g. the end surfaces of the rotor-side fitting portion 41*b* or the end fitting portion 37*a* in the axial directions) become substantially flat, thereby significantly suppressing costs necessary for working the fitting parts. Besides, the rotor 31 can be fixed to the rotor shaft portion 46 without complicated work, and in operation, a coupling force can be obtained by which the rotor 31 is prevented from being turned in the circumferential directions with respect to the rotor shaft portion 46. The rotor-side fitting portion 41*b* of the first pressing member 41 is fitted to the end fitting portion 37*a* formed in the boss portion 37 of the most upstream rotor vane 34 of the rotor 31. The first pressing member 41 is made of a material (stainless steel) having a lower linear expansion coefficient than aluminum making the rotor 31, and thereby in operation, expands in the radial directions by less volume than the rotor 31 does in the radial directions. In operation, therefore, the rotor-side fitting portion 41*b* (the first pressing member 41) is more securely fitted to the end fitting portion 37*a* (the rotor 31) than when the rotor 31 is assembled. The same is applied to the fitting of the second pressing member 42 and the rotor 31. In addition, the rotor 31 is made of aluminum or aluminum alloy and thereby becomes lighter. Since the working fluid is water vapor and the temperature of water vapor introduced into the axial flow compressor 10 is set to, for example, 150° C. or below under an atmospheric pressure or below, the rotor 31 can be made of aluminum or aluminum alloy and thereby can be lighter and more precisely wrought. Besides, the rotor 31 and the pressing members 41 and 42 (and the rotor vane 34 and the spacer 35) can be fitted to each other lest they should be relatively displaced in the circumferential directions, even if the end surfaces thereof in the axial directions are flat and ring-shaped contact surfaces in the circumferential directions. This saves a fitting structure by tooth coupling, key coupling or the like, thereby suppressing costs necessary for working the fitting parts. In the case where the axial flow compressor 10 is provided with plural stages of rotor vanes e.g. seven stages of rotor vanes, the downstream rotor vanes may be made of titanium or a titanium alloy, because the temperature of a downstream portion of the axial flow compressor 10 becomes about 250° C.

Furthermore, in the embodiment, since the spacer 35 and the rotor vane 34 are separate and fitted to each other, when the axial flow compressor 10 is in operation, the pressing forces of the pressing members 41 and 42 increase in accordance with the difference between an expansion volume of the rotor 31 and an expansion volume of the rotor shaft portion 46, thereby obtaining a coupling force by which the spacer 35 and the rotor vane 34 can be prevented from being mutually turned relatively in the circumferential directions. Besides, the rotor vane 34 and the spacer 35 are separate and hence can be individually wrought, thereby improving the workability of the rotor 31 using small blanks for working.

Moreover, in the embodiment, the inner space 31*a* of the rotor 31 formed with the rotor shaft portion 46 has a larger diameter than the rotor shaft portion 46 and is provided with the disk member 44, thereby hollowing a central part of the rotor 31 to lighten the rotor 31. Besides, the disk member 44 supports a middle part of the rotor shaft portion 46, thereby raising the natural frequency of the rotor shaft portion 46.

In addition, in the embodiment, the rotor shaft portion 46 is made of titanium or titanium alloy and the disk member 44 is made of stainless steel or stainless alloy. When the axial flow compressor 10 is in operation, therefore, the difference between a thermal expansion volume of the rotor 31 and a thermal expansion volume of the rotor shaft portion 46 can be more easily secured and the rotor shaft portion 46 becomes more rigid.

The present invention is not limited to the above embodiment, and hence, various changes, modifications and the like can be expected without departing from the scope of the present invention. For example, the embodiment shows the axial flow compressor 10 used for a refrigerator, but the present invention is not limited to this example. For example, the axial flow compressor 10 may be configured, for example, as a compressor used for a chiller for obtaining cooling water, an air conditioner, a concentrator or the like.

The working fluid is not limited to water vapor, and for example, a variety of fluids such as air, oxygen, nitrogen and a hydrocarbon process gas can be used.

Furthermore, in the embodiment, the first pressing member 41 is in contact with the rotor vane 34 while the second pressing member 42 is in contact with the spacer 35. However, the present invention is not limited to this, and hence, each pressing member 41, 42 may be in contact with either of the rotor vane 34 and the spacer 35. Specifically, both pressing members 41 and 42 may be in contact with the corresponding rotor vanes 34, both pressing members 41 and 42 with the corresponding spacers 35, or the first pressing member 41 with the spacer 35 while the second pressing member 42 with the rotor vane 34.

Moreover, in the embodiment, the rotor 31 has a plurality of the rotor vanes 34 but the present invention is not limited to this, and hence, the rotor 31 may have the single rotor vane 34.

In addition, in the embodiment, the rotor vane 34 is separate from the spacer 35 but both may be united.

Figure 4:
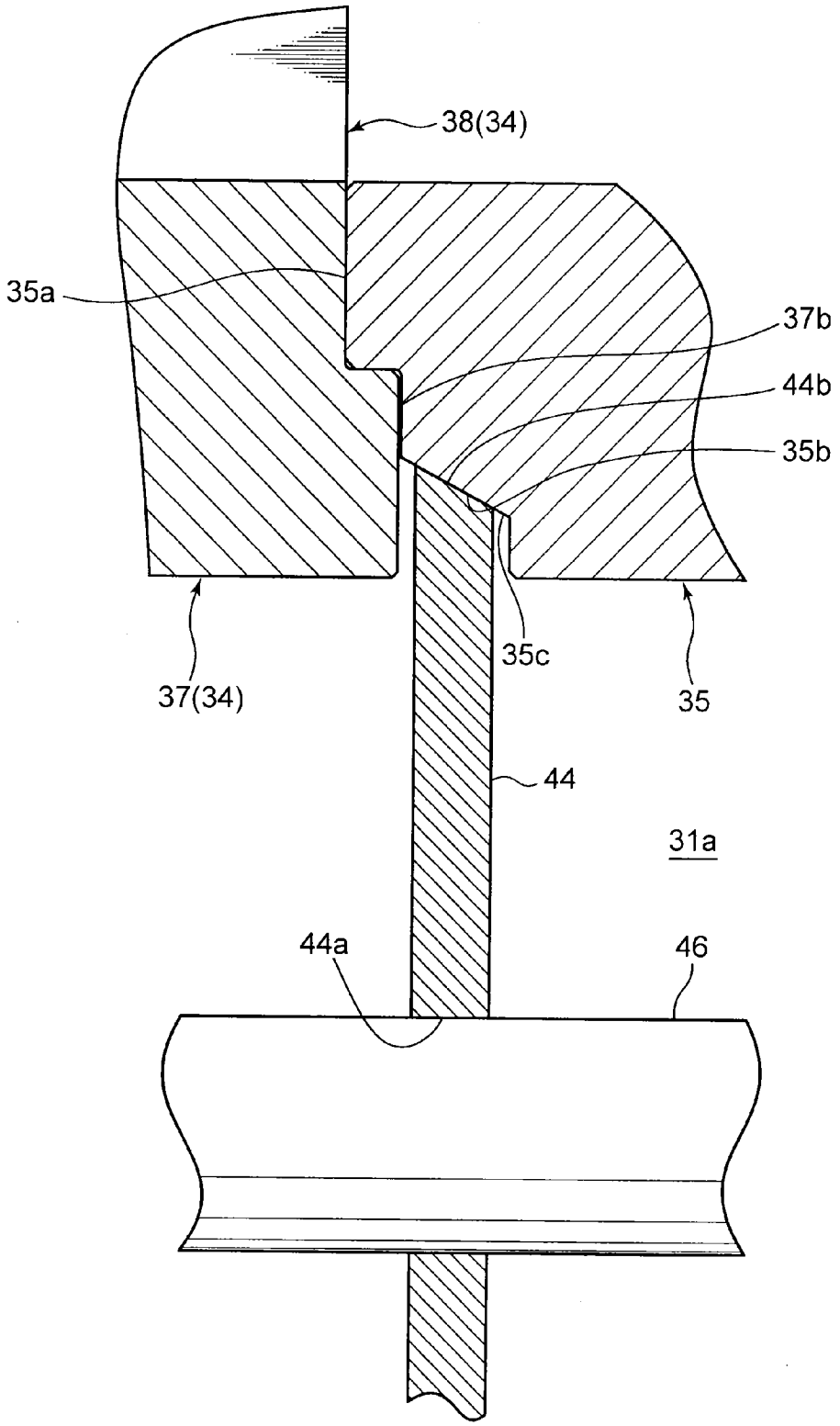
FIG. 4 is a sectional view mainly showing a fitting part of a rotor vane and a spacer in an axial flow compressor according to another embodiment of the present invention.

Moreover, in the embodiment, the disk member 44 is fastened onto the spacer 35 with the bolt 51. However, the present invention is not limited to this configuration. For example, as shown in FIG. 4, the disk member 44 may be disposed to be displaceable with respect to the spacer 35 in the axial direction of the rotor shaft portion 46. Specifically, the disk member 44 may be formed into a circular truncated conical shape. In the modification, an outer surface 44*b* of the disk member 44 may be slanted with respect to the axial direction and disposed in the concave portion 35*b* of the spacer 35. Likewise, an inner surface 35*c* of the concave portion 35*b* may be slanted in such a manner as to be aligned with the outer surface 44*b* of the disk member 44. The inner surface 35*c* of the concave portion 35*b* and the outer surface 44*b* of the disk member 44 may be in contact with each other. The width of the concave portion 35*b* in the axial direction of the rotor shaft portion 46 may be set wider than the thickness of the disk member 44. The above configuration enables to move the disk member 44 in the axial direction depending on deformation of the spacer 35 resulting from centrifugal force or heat. Thus, the above configuration successfully copes with deformation of the spacer 35.

An outline of the above embodiment will be described below.

(1) In the axial flow compressor according to the above embodiment, the first pressing member and the second pressing member hold the rotor from both sides in the axial directions of the rotor shaft portion. When compressing a working fluid in operation, the axial flow compressor generates heat to thereby expand the rotor by more volume than the rotor shaft portion in the axial directions, because the rotor shaft portion is made of a material having a lower linear expansion coefficient than that of a material making at least a part of the rotor. Hence, the rotor expands to increase the pressing force between the rotor and the first pressing member and the pressing force between the rotor and the second pressing member, thereby making the coupling force of the fixing portion greater in operation than when the rotor is assembled. Therefore, without tooth coupling, key coupling or the like, the rotor can be fitted to the pressing members lest the rotor should be relatively displaced in the circumferential directions. This makes it possible to suppress costs necessary for working the fitting parts, fix the rotor to the rotor shaft portion without complicated work and obtain a coupling force in operation by which the rotor can be prevented from being turned in the circumferential directions with respect to the rotor shaft portion.

(2) The above working fluid may be water vapor.

(3) The material making at least a part of the rotor may be aluminum or aluminum alloy.

(4) It is preferable that the rotor includes a plurality of the rotor vanes in the axial directions of the rotor shaft portion, and rotor vanes other than at least the most upstream rotor vane are made of aluminum or aluminum alloy. According to this aspect, the most upstream rotor vane can be prevented from being eroded by the working fluid (e.g. water vapor) and the rotor becomes lighter.

(5) The most upstream rotor vane may be made of aluminum or aluminum alloy and subjected to anodic coating. According to this aspect, if the working fluid is water vapor, the most upstream rotor vane can be prevented from being eroded and the rotor becomes still lighter.

(6) The most upstream rotor vane may be made of titanium, titanium alloy, stainless steel or stainless alloy. According to this aspect, if the working fluid is water vapor, the most upstream rotor vane can be prevented from being eroded and be more durable.

(7) The rotor may include a plurality of rotor vanes in the axial directions thereof and a spacer between the rotor vanes adjacent to each other, and preferably in this case, the spacer and the rotor vanes may be separate and fitted to each other. According to this aspect, when the axial flow compressor is in operation, the pressing forces of the pressing members increase in accordance with the difference between an expansion volume of the rotor and an expansion volume of the rotor shaft portion, thereby obtaining a coupling force by which the spacer and the rotor vanes can be prevented from being mutually turned relatively in the circumferential directions. Besides, the rotor vanes and the spacer are separate and hence can be individually wrought, thereby improving the workability of the rotor using small blanks for working.

(8) An inner space of the rotor penetrated by the rotor shaft portion may be provided with a disk member, and the rotor shaft portion may penetrate the disk member. According to this aspect, the inner space of the rotor formed with the rotor shaft portion has a larger diameter than the rotor shaft portion and is provided with the disk member, thereby hollowing a central part of the rotor to lighten the rotor. Besides, the disk member supports a middle part of the rotor shaft portion, thereby raising the natural frequency of the rotor shaft portion.

(9) The rotor shaft portion may be made of titanium or titanium alloy. According to this aspect, when the axial flow compressor is in operation, the difference between a thermal expansion volume of the rotor and a thermal expansion volume of the rotor shaft portion can be more easily secured and the rotor shaft portion becomes more rigid.

As described above, the axial flow compressor according to the above embodiment is capable of suppressing costs necessary for working the fitting parts of a rotor and a rotor shaft portion and fitting the rotor securely with respect to the rotor shaft portion.

EXPLANATION OF CODES

31: rotor
31*a*: inner space
33: stationary vane
34: rotor vane
35: spacer
40: driving shaft
41: first pressing member
42: second pressing member
43: nut (as an example of the fixing portion)
44: disk member
46: rotor shaft portion
47: end shaft portion

What is claimed is:

1. An axial flow compressor which compresses a working fluid, comprising:

a rotor including a rotor vane;

a first pressing member coming into contact with one end surface of the rotor;

a second pressing member coming into contact with the other end surface of the rotor;

a rotor shaft portion penetrating the first pressing member, the rotor and the second pressing member; and a fixing portion which fixes the first pressing member and the second pressing member on the rotor shaft portion with the first pressing member and the second pressing member holding the rotor between, wherein the rotor shaft portion is made of a material having a lower linear expansion coefficient than that of a material making at least a part of the rotor.

2. The axial flow compressor according to claim 1, wherein the working fluid is water vapor.

3. The axial flow compressor according to claim 1, wherein the material making at least a part of the rotor is aluminum or aluminum alloy.

4. The axial flow compressor according to claim 1, wherein the rotor includes a plurality of the rotor vanes in the axial directions of the rotor shaft portion, and rotor vanes other than at least the most upstream rotor vane are made of aluminum or aluminum alloy.

5. The axial flow compressor according to claim 4, wherein the most upstream rotor vane is made of aluminum or aluminum alloy and is subjected to anodic coating.

6. The axial flow compressor according to claim 4, wherein the most upstream rotor vane is made of titanium, titanium alloy, stainless steel or stainless alloy.

7. The axial flow compressor according to claim 1, wherein the rotor includes a plurality of rotor vanes in the axial directions thereof and a spacer between the rotor vanes adjacent to each other, and the spacer and the rotor vanes are separate and fitted to each other.

8. The axial flow compressor according to claim 1, wherein an inner space of the rotor penetrated by the rotor shaft portion is provided with a disk member, and the rotor shaft portion penetrates the disk member.

9. The axial flow compressor according to claim 8, wherein the rotor shaft portion is made of titanium or titanium alloy.

* * * * *